United States Patent [19]

Bööse

[11] 4,359,799

[45] Nov. 23, 1982

[54] DOCTOR BLADES

[76] Inventor: Åke A. Bööse, Larsbergsvägen 46, 18138 Lidingö, Sweden

[21] Appl. No.: 160,768

[22] Filed: Jun. 18, 1980

[51] Int. Cl.[3] ..... B41F 35/04

[52] U.S. Cl. ..... 15/256.51; 100/174; 101/425

[58] Field of Search ..... 15/256.51; 101/425; 100/174; 118/652; 355/15; 430/125

[56] References Cited

U.S. PATENT DOCUMENTS

| | | | |
|---|---|---|---|
| 1,552,363 | 9/1925 | Vickery | 15/256.51 |
| 1,803,927 | 5/1931 | Vedder | 15/256.51 |
| 2,007,418 | 7/1935 | Akre | 15/256.51 |
| 2,487,409 | 11/1949 | Baker | 15/256.51 |
| 2,948,012 | 8/1960 | Scott | 15/256.51 |
| 3,378,876 | 4/1968 | Sisson | 15/256.51 |

FOREIGN PATENT DOCUMENTS

| | | | |
|---|---|---|---|
| 78736 | 10/1933 | Sweden | 15/256.51 |

*Primary Examiner*—Edward L. Roberts
*Attorney, Agent, or Firm*—Blanchard, Flynn, Thiel, Boutell & Tanis

[57] ABSTRACT

A composite doctor blade assembly includes a length of steel strip 21, forming the doctor blade, and a similar but narrower back-up blade 22. The strips 21, 22 are clamped between a resiliently flexible carrier strip 23 and an arched resilient strip 24 held together under tension by ties 25 passing through apertures 23*a,* 24*a.* To make the blade assembly longitudinally flexible, the apertures are elongated.

The plate 23 is clamped in a holder between an intermediate element 11 and a bottom element 12 with the interposition of an interchangeable cylindrical packing element 13. The top element 14 is channel shaped to provide extra rigidity.

12 Claims, 12 Drawing Figures

DOCTOR BLADES

FIELD OF THE INVENTION

The present invention relates to doctor blades, more particularly but not exclusively for stripping excess ink from a rotating printing roll in the surface of which there are arranged depressions for filling with printing ink. The doctor blade is attached to a holder carried by an adjustable apparatus which determines the force with which the doctoring edge of the blade lies against the printing roll. Such blades are exposed to wear and must be changed after a period of use.

A conventional doctor blade consists of a strip which is formed along its length with a thinner forward portion and a thicker rear portion. The thinner forward portion is formed by a comparatively expensive grinding operation.

The free edge of the thinner portion is intended for use as a stripping edge, while the thicker portion is intended for clamping in a standard type of blade holder for the printing machinery in question. The advantage of the thin portion of even thickness is that wear on it can take place without the wear causing any unacceptable alteration of the profile of the scraping or doctoring edge engaging the printing roll.

In long printing runs, the blade may have to be removed, either for replacement due to wear or for cleaning. When changing blades, the blade is removed together with a relatively heavy removable portion of the standard holder and is carried to a place for changing the blade or to a hot steam bath in which the blade is to be cleaned. This work is often arduous, since the weight of the removable holder and the blade attached thereto is considerable, and the walking distance in the printing hall to the work bench or to the steam bath is in many cases so long that the holder portion with the blade needs to be transported on a trolley.

British patent specification No. 1,507,825 discloses the use of a replaceable strip as a doctor blade. The strip is clamped in a doctor blade holder which is, close to the strip itself, relatively stiff lengthwise. Such a holder cannot fully support the doctor blade strip in its effort to maintain even pressure between the doctor blade edge and the printing cylinder. As a result the print quality and the doctor blade life will be low.

U.S. Pat. No. 2,007,418 also discloses a doctor blade holding assembly for a strip, this holding assembly also being relatively stiff lengthwise with disadvantages. The device is designed for negative doctoring, ie. scraping the roll, consequently without special requirements a doctor blade for a printing roll.

BRIEF DESCRIPTION OF THE DRAWINGS

A preferred embodiment of the invention will now be described by way of example with reference to the accompanying drawings, in which.

DETAILED DESCRIPTION

Figure 1:
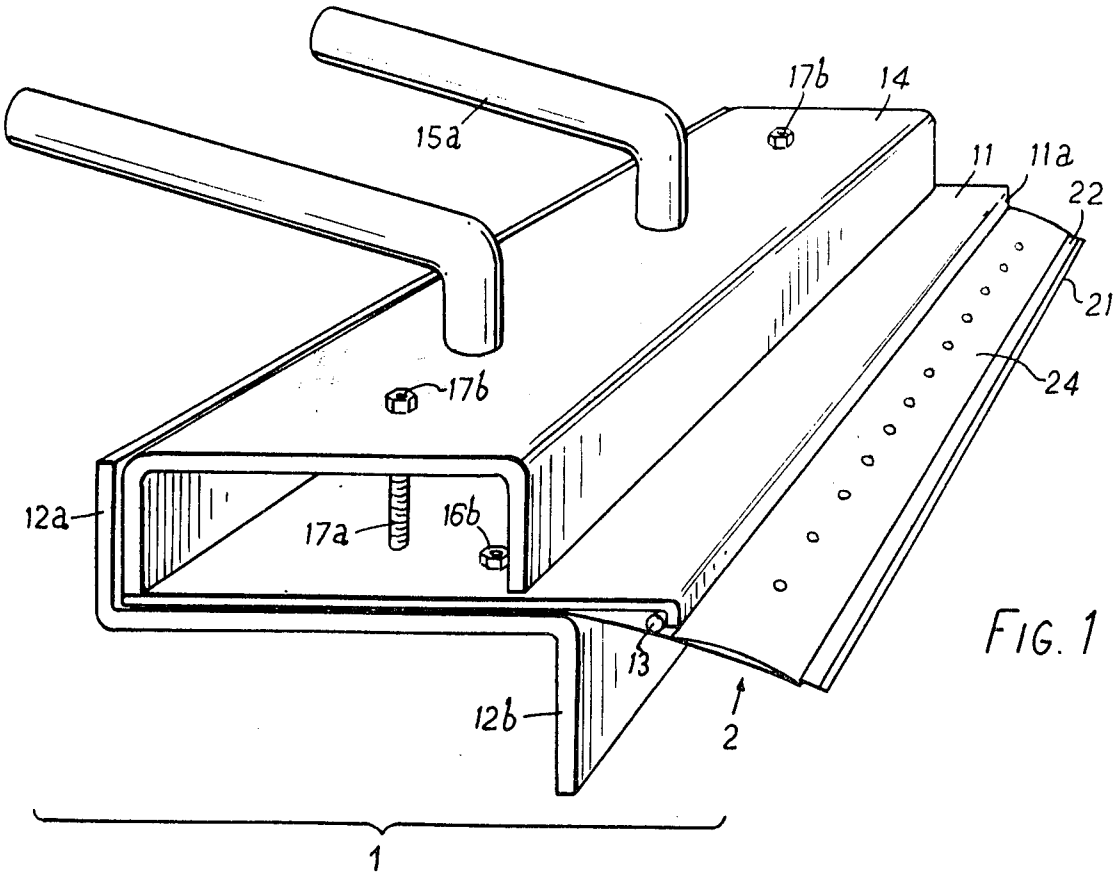
FIG. 1 is a perspective view of a complete doctor blade and holder.
Figure 2:
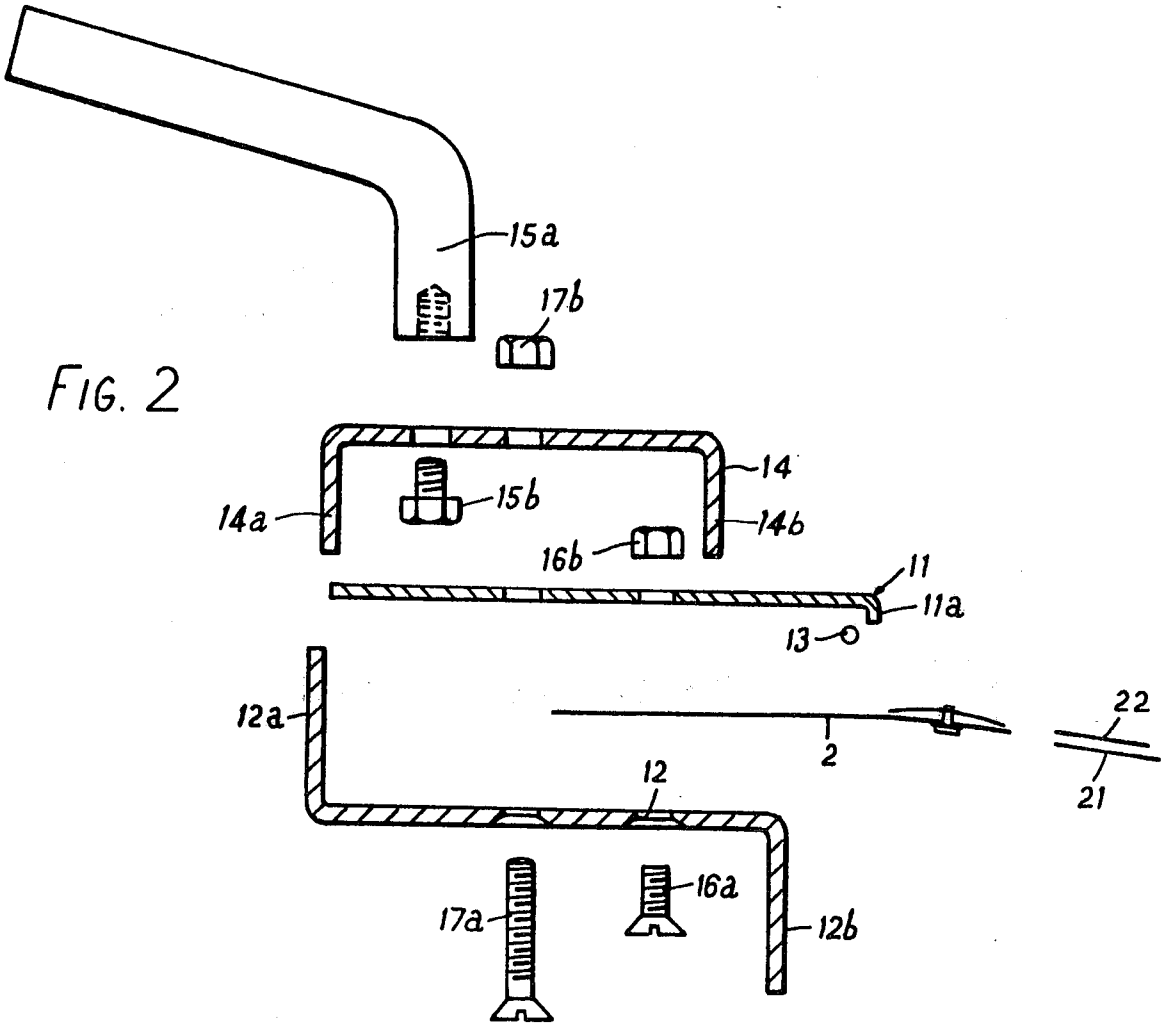
FIG. 2 is an exploded view in cross section, through the complete holder shown in FIG. 1.

FIGS. 1 and 2 show a doctor blade assembly consisting of a flexible doctor blade sub-assembly 2 including the doctor knife blade 21 with its back up blade 22 and a light-weight rigid holder 1.

As shown in FIG. 1 and 2 the light-weight doctor blade holder 1 consists of three sheet-metal elements of different cross sections, each accurately straight. The bottom element 12 is formed like a Z and has an upstanding rear flange **12*a* and a depending front flange 12*b*. The middle element 11 is formed as an L having a small depending front flange 11*a*. The top element 14 formed like an inverted U having depending front and rear flanges 14*a* and 14*b*. The middle element 11 is clamped to the bottom member 12 by a row of bolts 16*a* having corresponding nuts 16*b*. Between the middle element 11 and the bottom element 12 is the clamped flexible sub-assembly, normally permanently. To give the middle member 11 an accurate and straight edge to support the springy flexible blade sub-assembly 2 a metal rod or tube 13 is positioned in the corner of the middle element. A range of rods or tubes 13 of different diameters may be made available to enable the pressure of blade application to be adjusted. The top member 14 completes the holder 1 by giving it stiffness, straightness and a convenient overall thickness corresponding to the thickness of the conventional, heavy solid metal holder which the holder replaces. The top member 14 is clamped to the other two members 11, 12 by means of say four or six bolts 17*a* with corresponding nuts 17*b* along the length of the holder. The heads of bolts 17*a* and 16*a* are counter-sunk into the bottom member 12 so that the bolt heads lie flush with the bottom surface of the bottom member 12**. This surface is directed towards the doctor blade holder bed in the printing press unit which is a straight plane parallel to the printing cylinder axis demanding an accurate and plane surface of the doctor blade holder.

The holder is preferably provided with two handles **15*a* fixed to the holder by means of bolts 15*b* passing through the top member 14**.

Figure 3:
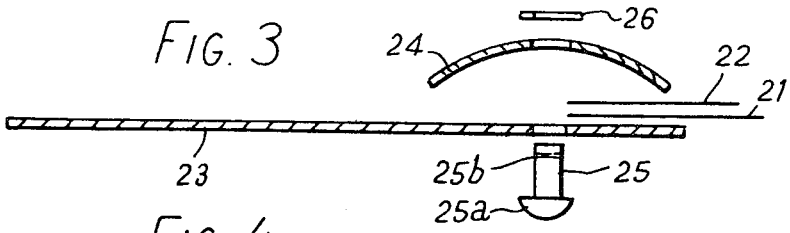
FIG. 3 is an exploded view in cross section, of the flexible doctor blade sub-assembly.
Figure 4:
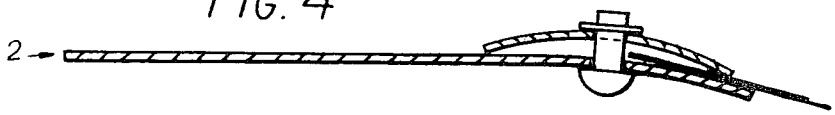
FIG. 4 is a view in cross section of the flexible blade sub-assembly when assembled as taken along line IV—IV in FIG. 5.

The doctor blade 21 is a length of thin, steel strip cut from stock of uniform thickness and is supported by a back-up strip 22 which also is a thin steel strip of uniform thickness but narrower than the doctor blade 21. Both blades are resiliently clamped, as shown in FIG. 4 in the flexible sub-assembly 2. This consists of a wider flexible carrier plate 23, which is clampable or fixable in the holder 1 or in a conventional solid metal holder, and a narrower flexible presser plate 24, which is disposed with its front edge almost flush with the front edge of the wider plate 23. Both plates 23, 24 are of spring steel 0.3 mm thick (or less). As shown in FIG. 3 the arched narrower plate 24 is transversely curved but can also be bent to a corresponding degree, thus comprising two flat portions at an obtuse angle to each other. The plates 24, 23 are held in position by a plurality of ties 25 arranged in a straight row, and each having a flange **25*a*** at one end in the shape of a bolt head and a groove 25*b* near the other end to receive a circlip 26.

The free length between the two clamping surfaces presented respectively by the flange 25*a* and the circlip 26 is substantially greater than the combined thickness of the plates 24, 23 and the blades 22, 21.

This free length of the ties and the curvature of the narrower presser plate 24 are so selected relative to each other that the desired clamping pressure is obtained between the front edge portions of the plates 24, 23.

The elongated holes 24*a*, 23*a* of the plates 24, 23 through which the ties 25 pass accurately fit the ties 25 transversely and lie with their extended longer dimensions in a straight row parallel to the edges of the plate 23. This permits convenient insertion of the blades 22, 21 to an accurately determined position by first the back-up blade 22 being inserted up to engagement with the ties 25 and then the doctor blade 21 being inserted up to engagement with the ties 25, which thus also serve as stops for the two blades 22, 21.

The doctor blade 21 consists of a thin, steel strip of constant thickness and width, the thickness of the strip being in the range 0.05–0.15 mm. The thickness of the doctor blade is thus so small that the blade 21 can be curved in the plane of FIG. 5, the right hand side of the blade being then wrinkled, enabling the blade to be drawn progressively out from or pressed progressively between the plates 24, 23 along the length of the blade, from one end to the other with the aid of a rag.

The back-up blade 22 is normally identical to the doctor blade 21 except for the width which is 1 to 2 mm less than the width of the doctor blade.

Figure 6:
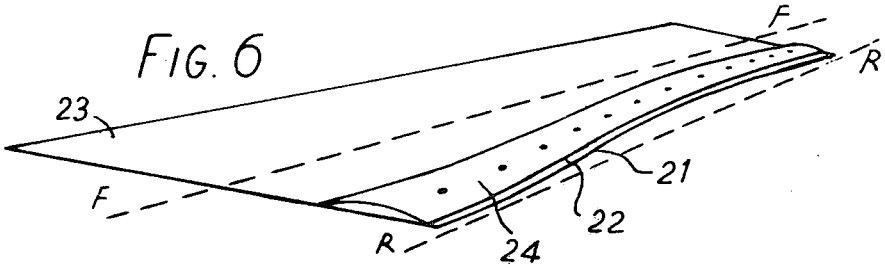
FIG. 6 is a schematic perspective view of the blade sub-assembly showing the lengthwise flexibility of the sub-assembly.

Since the doctor blade and the back-up blade consist of thin steel strips, the doctor blade supported by the back-up blade can easily adjust itself to unevenesses on the printing cylinder, and this adjusting capacity is further substantially increased by the two blades being resiliently clamped in the flexible sub-assembly. The flexibility of this sub-assembly is shown in FIG. 6, from which it is clear that the front edge of the flexible sub-assembly 2 has a flexing capacity both lengthwise and cross-wise relative to a straight reference line R—R when the holder is fixed straight and stiffly along a line F—F and to the left of this line. This flexibility lengthwise directly results from the elongated holes 23*a*, 24*a*, these holes being extended at least 30 percent along the hole-row-axis, both in the wider plate 23 and in narrower plate 24. These holes allow the two plates 23, 24 to slide relatively to one and other when the blade flexes lengthwise, as can be seen in FIG. 6.

Figure 5:
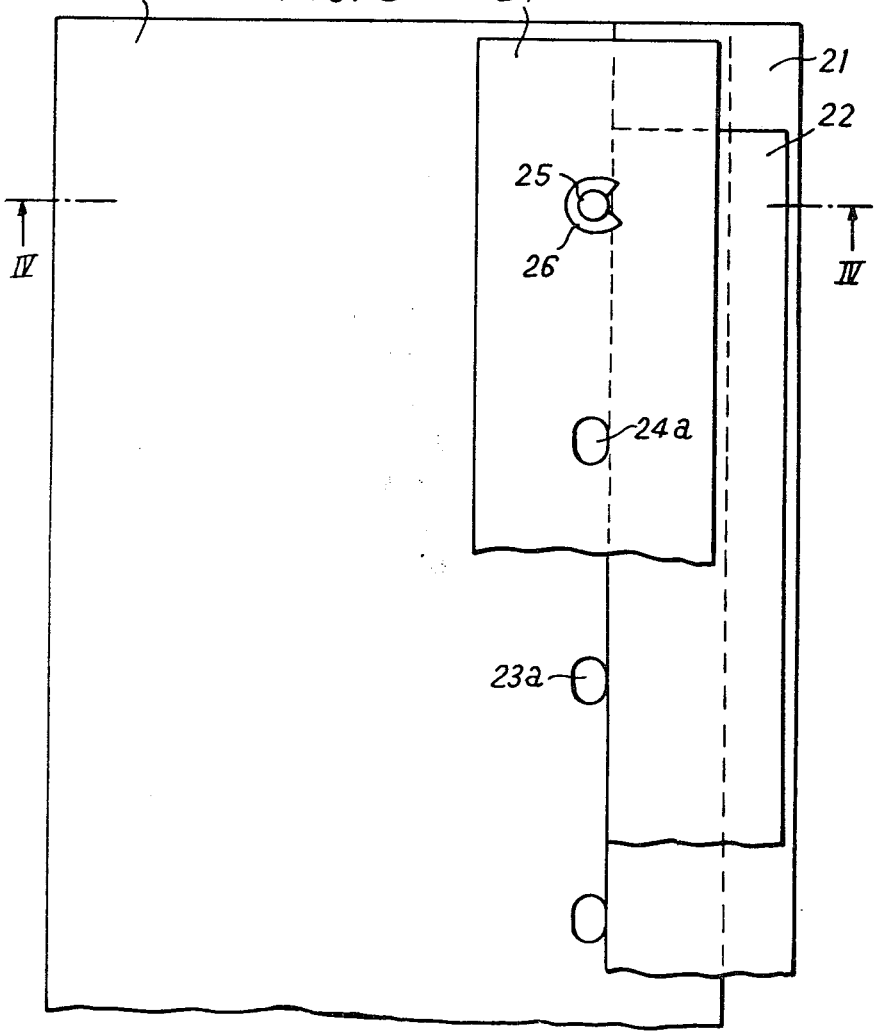
FIG. 5 is a fragmentary plan view of one end of the flexible blade sub-assembly.

The flexible sub-assembly and the doctor blade 21 have a slightly greater length than the printing cylinder, so that the blade covers the entire length of the printing cylinder. The back-up blade 22 however may be slightly shorter than the doctor blade as shown in FIG. 5, so that the doctor blade 21 itself can be easily and separately gripped at one end when changing blades.

Figure 7:
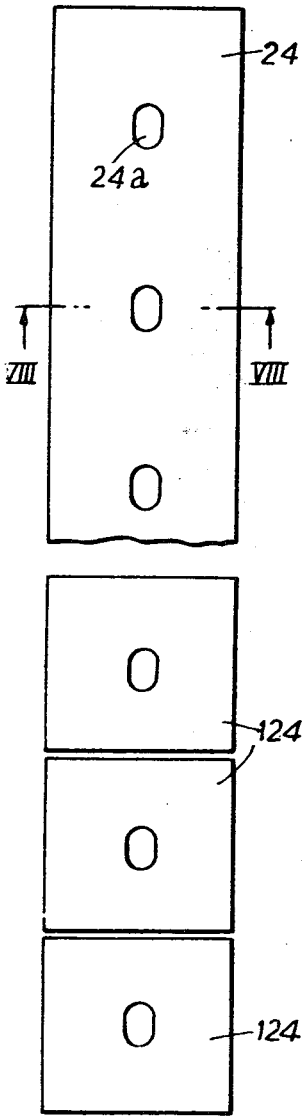
FIGS. 7, 9 and 11 are plan views of alternative presser plates.
Figure 9:
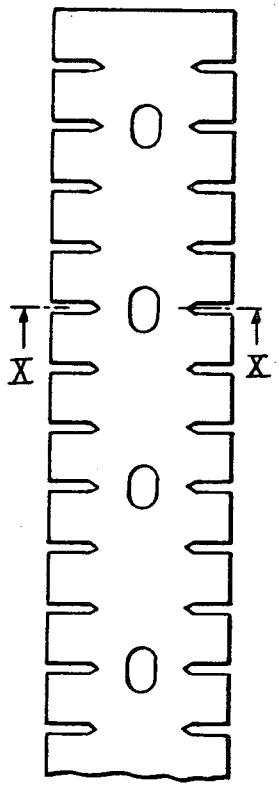
Figure 11:
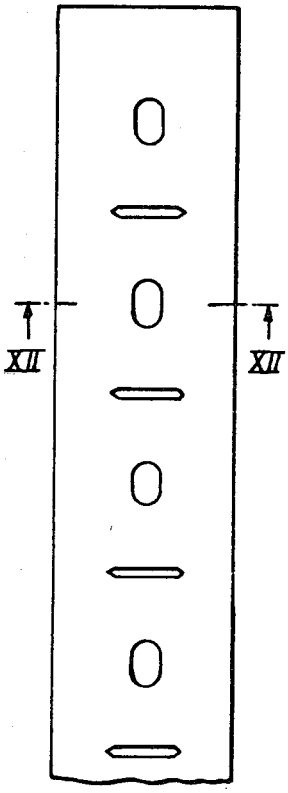
Figure 8:
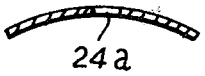
FIGS. 8, 10 and 12 are respective cross sections on the lines VIII, X and XII of FIGS. 7, 9 and 11.
Figure 10:
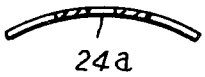
Figure 12:
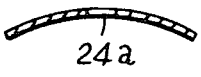

As shown in FIGS. 7 and 8 the presser plate means can alternatively consist of a row of separate sections 124, each having one or more elongated aperture 24*a*, replacing the single presser plate 24. Alternatively the presser plate 24 can on the other hand be notched or slotted transversely as shown in FIGS. 9 and 10 and FIGS. 11 and 12 respectively to increase the lengthwise flexibility of the presser plate still more.

I claim:

1. A doctor blade assembly comprising a resiliently flexible carrier plate, said carrier plate having a rearward mounting portion by which it is adapted to be clampingly mounted and a free forward portion, arched presser plate means extending along the carrier plate with its concave side directed towards the carrier plate, said presser plate means overlying only said forward portion of said ccarrier plate, a resiliently flexible doctor blade strip of constant thickness clamped between the outer edges of the carrier plate and the presser plate means and a row of ties passing through apertures in the carrier plate and the presser plate means to hold the presser plate means in a stressed condition to clamp the doctor blade strip, the apertures in the carrier plate and presser plate means being elongated to permit lengthwise movement of the ties relative to the carrier plate and/or the presser plate means.

2. An assembly according to claim 1, wherein the presser plate means comprises a continuous arched resilient strip.

3. An assembly according to claim 2, wherein the presser plate strip is transversely slotted or notched.

4. An assembly according to claim 1, wherein, the presser plate means comprises a plurality of short lengths of arched resilient strips.

5. An assembly according to any one of the preceding claims wherein a resilient flexible backing strip, narrower than the doctor blade strip, is located between the presser plate means and the doctor blade strip.

6. An assembly according to any one of claims 1–4 wherein the ties each comprise a separate tie rod having a head at one end and a groove near the other end, the groove receiving a circlip.

7. An assembly according to claim 1, including a holder for fixedly supporting the carrier plate, the holder including a platelike intermediate element, a channel-shaped top element having front and rear downwardly projecting flanges bearing on said intermediate element, said intermediate element having a width greater than the top element, a bottom element positioned below and substantially underlying the intermediate element, the bottom element having an upstanding rear flange which is located behind and overlaps the rear flange of the top element, the bottom element also having a depending front flange which is positioned below a forward portion of the intermediate element, the carrier plate having the rear portion thereof clampingly held between the intermediate and bottom elements so that the carrier plate forward portion projects outwardly beyond the forward edge of the intermediate element, said arched presser plate means being positioned forwardly of said intermediate element, and means for clamping the three elements together so that the carrier plate is clamped between the forward portions of the intermediate and bottom elements.

8. An assembly according to claim 7, wherein the doctor blade strip is held in position solely due to its being resiliently clampingly held between the arched presser plate means and said carrier plate, and a resilient flexible backing strip disposed in overlying relationship to the doctor blade strip and clampingly held between the presser plate means and the doctor blade strip, said flexible backing strip being narrower than the doctor blade strip.

9. An assembly according to claim 7, wherein the forward portion of the intermediate element projects forwardly a substantial distance beyond the front flange of the bottom element, said intermediate element at its forward edge terminating in a short downwardly directed flange for angularly deflecting the forward portion of the carrier plate downwardly relative to that portion of the carrier plate which is clampingly held between the intermediate and bottom elements.

10. An assembly according to claim 9, including an elongate cylindrical member, of rodlike or tubelike configuration, disposed in the corner formed at the forward edge of said intermediate element by said short downwardly directed flange, said elongate cylindrical member bearing down on said forward portion of said carrier plate, such that said short downwardly directed flange acts through said elongate cylindrical member to angularly deflect said forward portion of said carrier plate downwardly, said elongate cylindrical member providing an accurate and straight edge to bear against said carrier plate.

11. An assembly according to claim 1, in which said arched presser plate means is a flexible presser plate somewhat narrower than said flexible carrier plate and disposed with its front edge almost flush with, but somewhat retracted from, the front edge of said carrier plate, said presser plate being urged by said row of ties in a manner to cause the rearward and forward edges of the presser plate to tend to bear against the upper face of said carrier plate along only two lines of contact which are spaced rearward from the forward edge of said carrier plate, said doctor blade strip being interposed between said presser plate and carrier plate at the forward one of said two lines of contact, the front portion of said carrier plate being held in a resiliently flexed and thereby cross-sectional arched condition by said arched presser plate and ties but wherein the cross-section radius of curvature of said carrier plate is greater than that of said presser plate, the convex side of said carrier plate facing the concave side of said presser plate, said doctor blade assembly being flexible, so as to permit bending of said doctor blade assembly and of each of said presser plate and carrier plate forward portion and doctor blade strip along the length axes thereof, even with the rearward edge portion of said carrier plate being held rigidly against bending of its longitudinal axis.

12. A holder and doctor blade assembly, comprising a top channel-like element having front and rear downwardly projecting flanges bearing on an intermediate element in the form of a plate of width greater than the top element, a bottom element having a plate portion which underlies the underside of the intermediate element, the bottom element having an upstanding rear flange which is disposed behind the rear flange off the top element and a depending front flange positioned below a forward region of the intermediate element, a resiliently flexible carrier plate having a rear portion which is clampingly positioned between the intermediate member and the plate portion of the bottom element, said carrier plate having a front portion which projects outwardly a substantial distance beyond the forward edge of the intermediate element, means for clamping the three elements together with the rear portion of the carrier plate clamped between the forward portions of the intermediate and bottom elements, arched presser plate means opposing the front portion of the carrier plate with its concave side directed toward the carrier plate, a resiliently flexible doctor blade strip of constant thickness resiliently clamped between the forward portion of the carrier plate and the presser plate means adjacent the outer edges thereof, said doctor blade strip projecting forwardly beyond said outer edges, and a row of ties passing through apertures in the carrier plate and the presser plate means to hold the presser plate means in a stressed condition to resiliently clamp the doctor blade strip therebetween.

* * * * *